US010635127B2

(12) United States Patent
Hirose

(10) Patent No.: US 10,635,127 B2
(45) Date of Patent: Apr. 28, 2020

(54) REFERENCE VOLTAGE GENERATOR CIRCUIT GENERATING REFERENCE VOLTAGE BASED ON BAND GAP BY CONTROLLING CURRENTS FLOWING IN FIRST AND SECOND VOLTAGE GENERATOR CIRCUITS

(71) Applicant: RICOH ELECTRONIC DEVICES CO., LTD., Osaka (JP)

(72) Inventor: Yohkoh Hirose, Amagasaki (JP)

(73) Assignee: RICOH ELECTRONIC DEVICES CO., LTD., Osaka (JP)

( * ) Notice: Subject to any disclaimer, the term of this patent is extended or adjusted under 35 U.S.C. 154(b) by 0 days.

(21) Appl. No.: 16/484,539

(22) PCT Filed: Nov. 9, 2017

(86) PCT No.: PCT/JP2017/040400

§ 371 (c)(1),
(2) Date: Aug. 8, 2019

(87) PCT Pub. No.: WO2018/146878

PCT Pub. Date: Aug. 16, 2018

(65) Prior Publication Data

US 2020/0057464 A1 Feb. 20, 2020

(30) Foreign Application Priority Data

Feb. 9, 2017 (JP) ..... 2017-022429

(51) Int. Cl.
*G05F 1/567* (2006.01)
*G05F 3/30* (2006.01)
*G05F 1/46* (2006.01)

(52) U.S. Cl.
CPC ..... *G05F 3/30* (2013.01); *G05F 1/567* (2013.01); *G05F 1/468* (2013.01)

(58) Field of Classification Search
CPC ..... G05F 1/468; G05F 1/567
(Continued)

(56) References Cited

U.S. PATENT DOCUMENTS 7,122,998 B2 * 10/2006 Chen ..... G05F 3/30 323/314
8,278,905 B2 * 10/2012 Harvey ..... G05F 3/30 323/313

(Continued)

FOREIGN PATENT DOCUMENTS

JP 5-173659 A 7/1993
JP 2007-018377 A 1/2007

(Continued)

OTHER PUBLICATIONS

English translation of International Preliminary Report on Patentability dated Aug. 22, 2019 in connection with PCT/JP2017/040400.

(Continued)

*Primary Examiner* — Gary A Nash
(74) *Attorney, Agent, or Firm* — Cooper & Dunham LLP

(57) ABSTRACT

A reference voltage generator circuit is provided with a first voltage generator circuit that generates a first direct-current voltage; a second voltage generator circuit that generates a second direct-current voltage; and an operational amplifier that generates a voltage difference between the first and second direct-current voltages. The reference voltage generator circuit generates a reference voltage based on a band gap by controlling currents flowing in the first and second voltage generator circuits based on the voltage difference, and includes a third voltage generator circuit including a PNP bipolar transistor, which is connected in parallel with the first voltage generator circuit. The third voltage generator circuit generates a third direct-current voltage corresponding to a base current flowing in the PNP bipolar (Continued)

transistor, and applies it to the operational amplifier with the first direct-current voltage.

4 Claims, 7 Drawing Sheets

(58) Field of Classification Search
USPC ..... 323/312–314
See application file for complete search history.

(56) References Cited

U.S. PATENT DOCUMENTS

| | | | | |
|---|---|---|---|---|
| 8,446,140 | B2 * | 5/2013 | Harvey | G05F 3/30 323/311 |
| 2006/0006927 | A1 * | 1/2006 | Nakada | G05F 3/30 327/539 |
| 2007/0182477 | A1 * | 8/2007 | Kim | G05F 3/30 327/539 |
| 2009/0201067 | A1 * | 8/2009 | Haneda | G05F 3/30 327/306 |

FOREIGN PATENT DOCUMENTS

| | | |
|---|---|---|
| JP | 2013-92926 A | 5/2013 |
| JP | 2014-16860 | 1/2014 |

OTHER PUBLICATIONS

International Search Report dated Jan. 16, 2018 in connection with International Application No. PCT/JP2017/040400 filed Nov. 9, 2017.

* cited by examiner

REFERENCE VOLTAGE GENERATOR CIRCUIT GENERATING REFERENCE VOLTAGE BASED ON BAND GAP BY CONTROLLING CURRENTS FLOWING IN FIRST AND SECOND VOLTAGE GENERATOR CIRCUITS

TECHNICAL FIELD

The present invention relates to a reference voltage generator circuit such as a band gap reference voltage generator circuit, and a reference voltage generation method.

BACKGROUND ART

Many systems and semiconductor circuits employ a band gap reference voltage generator circuit as means for generating a direct current (DC) reference voltage that is appropriately stable to temperature. There have been many conventional attempts to reduce temperature dependency of the output and generate an accurate reference voltage independent of temperature.

A conventional band gap reference voltage generator circuit generates a reference voltage by summing two voltages whose temperature gradients are opposite and balanced to each other. In this case, one of the voltages is a base-emitter voltage Vbe (this is a base-emitter voltage of a bipolar transistor with a temperature coefficient of −2 mV/° C.) that is a forward voltage of a PN junction and that has a negative temperature characteristic. The other voltage is a voltage having a positive temperature characteristic of a forward voltage difference (ΔVbe) of the PN junctions.

For example, Patent Document 1 aims to provide a reference voltage generator circuit having both of a high temperature characteristic and a low temperature characteristic and whose temperature range in which improved voltage accuracy is obtained is expanded. The reference current generator circuit is provided for outputting a reference voltage based on a band gap. The reference voltage generator circuit includes a reference voltage output unit, which includes a PN junction device and a plurality of resistance elements and outputs a voltage obtained by correcting the band gap of the PN junction device with the resistance elements. In addition, the reference voltage generator circuit has a switch for changing a temperature characteristic of the output voltage of the reference voltage output unit, and a switch operation unit for operating the switch according to temperature.

SUMMARY OF THE INVENTION

Problems to be Solved by the Invention

The voltage obtained by summing the two voltages also includes a non-linear term of the base-emitter voltage Vbe. Thus, the output voltage has an upwardly convex curve with a given temperature of the center. However, there have been cases where the temperature characteristic is insufficient depending on intended uses of target objects.

An object of the present invention is to solve the above problems, and provide a reference voltage generator circuit capable of improving the temperature dependency of the output voltage with a circuit simpler than that of the prior art.

Means for Dissolving the Problems

According to one aspect of the present invention, there is provided a reference voltage generator circuit including first and second voltage generator circuits and an operational amplifier. The first voltage generator circuit generates a first direct-current voltage, and includes a series connecting circuit of a first resistor and a first PN junction device. The second voltage generator circuit generates a second direct-current voltage, and includes a series connecting circuit of a second resistor, a third resistor, where a plurality of second PN junction devices is connected in parallel with each other. The operational amplifier generates a voltage difference between the first direct-current voltage and the second direct-current voltage. The first and second PN junction devices are configured to include diode-connected first and second PNP bipolar transistors, respectively, and the reference voltage generator circuit generates a reference voltage based on a band gap by controlling respective currents flowing in the first and second voltage generator circuits based on the voltage difference. The reference voltage generator circuit further includes a third voltage generator circuit including a series connecting circuit of a fourth resistor and a third PNP bipolar transistor, and being connected in parallel with the first voltage generator circuit. The third voltage generator circuit generates a third direct-current voltage corresponding to a base current flowing in the third PNP bipolar transistor, and applies the third direct-current voltage to the operational amplifier together with the first direct-current voltage.

Effect of the Invention

The reference voltage generator circuit according to the present invention further includes a correction circuit, which is a third voltage generator circuit including a voltage generator circuit of a resistor and a transistor, and is thus capable of reducing temperature deviation of an output voltage due to temperature and providing a highly accurate reference voltage without the need to increase the circuit size, as compared to the prior art.

MODE FOR CARRYING OUT THE INVENTION

Figure 1:
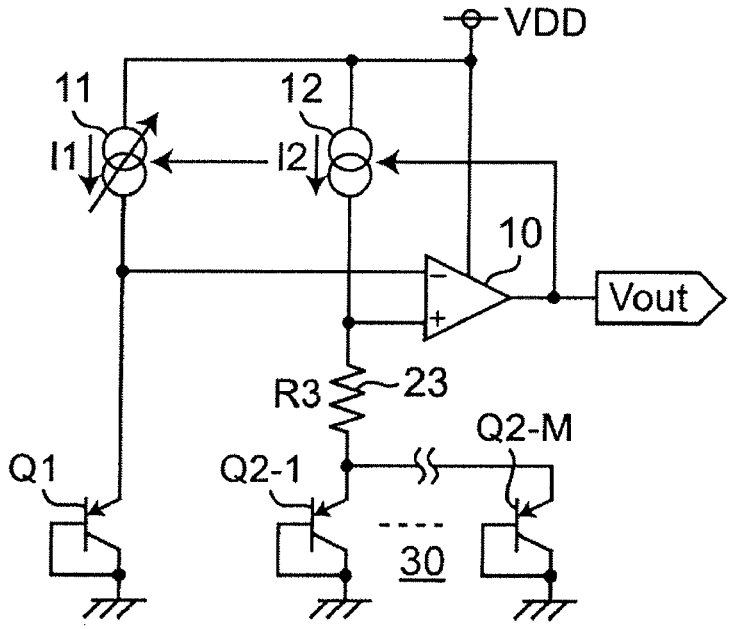
Fig.1 prior art
FIG. 1 is a circuit diagram showing an example configuration of a band gap reference voltage generator circuit according to comparative example 1.

Hereinafter, comparative examples and embodiments according to the present invention will be described with reference to the drawings. In the following embodiments, the same components are denoted by the same reference numerals.

COMPARATIVE EXAMPLE 1

FIG. 1 is a circuit diagram showing an example configuration of a band gap reference voltage generator circuit according to comparative example 1. Referring to FIG. 1, the band gap reference voltage generator circuit includes two current sources 11 and 12, a transistor Q1, a parallel transistor circuit 30 including M transistors Q2-1 to Q2-M connected in parallel, a resistor 23, and an operational amplifier 10. Then, the band gap reference voltage generator circuit generates a predetermined reference voltage based on a band gap reference voltage. In this case, each of the transistors Q1 and Q2-1 to Q2M is, for example, a PNP bipolar transistor, and the same holds true for the following description. In addition, the resistor 23 has a resistance value R3, and the same holds true for the following description.

Referring to FIG. 1, the current source 11 flowing a current I1, and the transistor Q1, whose base and collector are shorted, are connected in series, and a power supply voltage VDD is grounded via the current source 11 and an emitter and the collector of the transistor Q1. In addition, the current source 12 flowing a current I2, the resistor 23, and the parallel transistor circuit 30 including the M transistors Q2 whose respective base and collector are shorted, are connected in series. The power supply voltage VDD is grounded via the current source 12 and the parallel transistor circuit 30. In this case, the transistors Q1 and Q2-1 to Q2-M are so-called "diode-connected" transistors. A base-emitter voltage Vbe1 of the transistor Q1 is applied to an inverting input terminal of the operational amplifier 10. A voltage (a connection point voltage of the current source 12 and the resistor 23) obtained by adding a voltage drop in the resistor 23 to a base-emitter voltage Vbe2 of the M transistors Q2-1 to Q2-M is applied, as a reference voltage, to a non-inverting input terminal of the operational amplifier 10. It is noted that Vbe2 denotes a base-emitter voltage of the parallel transistor circuit 30. Further, the power supply voltage VDD is applied to the operational amplifier 10 as a power supply voltage.

In the band gap reference voltage generator circuit configured as described above, an output voltage Vout outputted from an output terminal of the operational amplifier 10 is applied to control input terminals of the current sources 11 and 12 to control the respective currents I1 and I2. A control system of the band gap reference voltage generator circuit generates the output voltage Vout, such that a voltage difference between the two voltages inputted to the operational amplifier 10 becomes substantially zero, and then the output voltage Vout is outputted as the reference voltage.

COMPARATIVE EXAMPLE 2

Figure 2:
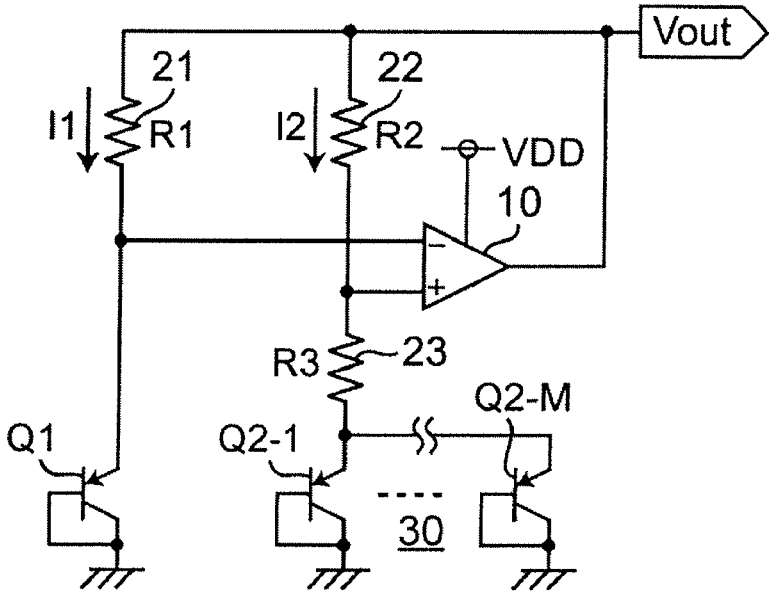
Fig.2 prior art
FIG. 2 is a circuit diagram showing an example configuration of a band gap reference voltage generator circuit according to comparative example 2.

FIG. 2 is a circuit diagram showing an example configuration of a typical band gap reference voltage generator circuit according to comparative example 2. Referring to FIG. 2, the band gap reference voltage generator circuit includes three resistors R1, R2, and R3, a transistor Q1, a parallel transistor circuit 30 including M transistors Q2-1 to Q2-M connected in parallel, and an operational amplifier 10. In this case, the resistor 21 has a resistance value R1, and the resistor R22 has a resistance value R2. The same holds true for the following description.

Referring to FIG. 2, the resistor 21 flowing a current I1, and the transistor Q1, whose base and collector are shorted, are connected in series to form a first series circuit, and the output terminal of the operational amplifier 10 is grounded via the resistor 21 and the transistor Q1. In addition, the resistor 22 flowing a current I2, the resistor 23, and the parallel transistor circuit 30, which includes the M transistors Q2 whose respective base and collector are shorted, are connected in series to form a second series circuit. In this case, the output terminal of the operational amplifier 10 is grounded via the resistors 22 and 23 and the parallel transistor circuit 30. A base-emitter voltage Vbe1 of the transistor Q1 is applied to an inverting input terminal of the operational amplifier 10. A voltage (a connection point voltage of the resistor 22 and the resistor 23) obtained by adding a voltage drop in the resistor 23 to a base-emitter voltage Vbe2 of the M transistors Q2-1 to Q2-M is applied, as a reference voltage, to a non-inverting input terminal of the operational amplifier 10. It is noted that a power supply voltage VDD is applied to the operational amplifier 10 as a power supply voltage.

In this case, the series circuit of the transistor Q1 and the resistor 21 configures a voltage generator circuit that generates a voltage corresponding to the current I1, while the series circuit of the parallel transistor circuit 30 and the resistors 22 and 23 configures a voltage generator circuit that generates a voltage corresponding to the current I2.

In the band gap reference voltage generator circuit configured as described above, the output voltage Vout outputted from the output terminal of the operational amplifier 10 is applied to the resistors 21 and 22 to cause the resistors 21 and 22 to flow the currents I1 and I2, respectively. A control system of the band gap reference voltage generator circuit generates the output voltage Vout, such that a voltage difference between the two voltages inputted to the operational amplifier 10 becomes substantially zero, and the output voltage Vout is outputted as a reference voltage.

In the band gap reference voltage generator circuit of FIG. 2, a temperature characteristic of the output voltage Vout is created by utilizing a negative temperature characteristic of a forward voltage of the PN junction and a positive temperature characteristic of a forward voltage difference of the PN junctions of the transistors Q1 and Q2-1 to Q2-M. In this case, the band gap reference voltage generator circuit generates the output voltage Vout of the operational amplifier 10 as a band gap reference voltage almost independent of temperature, by utilizing the positive and negative temperature characteristics. The output voltage Vout is expressed by the following equation.

$$Vout = R1 \times I1 + Vbe1 \quad (1)$$
$$= R2 \times I2 + R3 \times I2 + Vbe2$$

In this case, a virtual grounding condition by the operational amplifier 10 is expressed by the following equation.

$$R1 \times I1 = R2 \times I2 \quad (2)$$

The following equation (3) is obtained from the equation (2).

$$I2 = (R1/R2) \times I1 \quad (3)$$

In FIG. 2, the relationship between the base-emitter voltages Vbe1 and Vbe2 is expressed by the following equation.

$$Vbe1 = Vbe2 + R3 \times I2 \quad (4)$$

In this case, a voltage difference ΔVbe between the base-emitter voltages Vbe1 and Vbe2 is expressed by the following equation.

$$\Delta Vbe = R3 \times I2 \quad (5)$$
$$= (R1/R2) \times R3 \times I1$$

Therefore, the following equation is obtained by substituting the equation (5) into the equation (1).

$$Vout = Vbe1 + R1 \times (R2/R1 \times R3)\Delta Vbe \quad (6)$$
$$= Vbe1 + (R2/R3) \times \Delta Vbe$$

In this case, a current Iptat proportional to absolute temperature T is expressed by the following equation.

$$\text{Iptat} = R2/(R1 \times R3) \times \Delta Vbe \quad (7)$$

The respective base-emitter voltages Vbe1 and Vbe2 of the transistors are expressed by the following equations.

$$Vbe1 = kT/q \times \ln(I1/Is) \quad (8)$$

$$Vbe2 = kT/q \times \ln(I2/Is) \quad (9)$$

In these equations, k is a Boltzmann factor, q is an amount of electric charge, and Is is a process-dependent factor of the transistor. In this case, the output voltage Vout is expressed by the following equation using the equation (3).

$$Vout = Vbe1 + (R2/R3) \times kT/q \times \ln(I1/I2) \quad (10)$$
$$= Vbe1 + (R2/R3) \times kT/q \times \ln(R1/R2)$$

In this case, a temperature gradient of the base-emitter voltage Vbe1 is determined by the process, and the absolute temperature T is made constant by canceling the temperature gradient with the current Iptat of the remaining term. The above description is for cases where only a first-order linear component is present. In actual cases, a non-linear component is included, and the characteristic is as follows as shown in FIG. 3.

Figure 3:
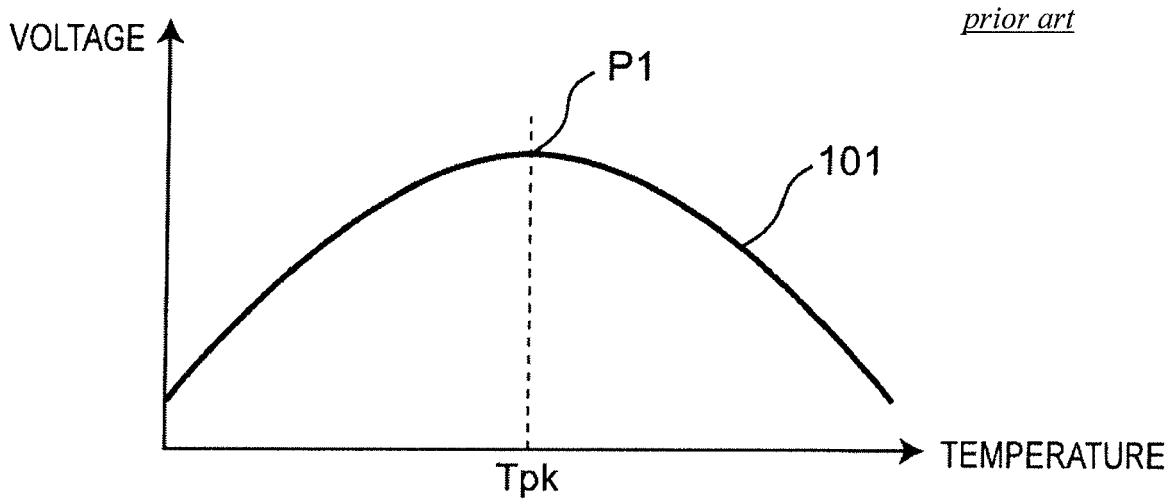
FIG. 3 is a graph showing a temperature characteristic of an output voltage of the band gap reference voltage generator circuit of FIG. 2.

FIG. 3 is a graph showing a temperature characteristic 101 of the output voltage Tout of the band gap reference voltage generator circuit of FIG. 2. As apparent from FIG. 3, the output voltage Tout of the band gap reference voltage generator circuit has a peak voltage at a temperature Tpk.

Meanwhile, a typical base-emitter voltage Vbe (T) when a temperature coefficient of a non-linear term is included, is expressed by the following equation.

$$Vbe(T) = Vbg(1-(T(T)) + Vbe0\sigma(kT/q) \times \ln(T(T)) + \sigma(kT/q) \times \ln(I(T)) \quad (11)$$

In this case, Vbg is a band gap energy voltage, T0 is a reference temperature, Vbe0 is a base-emitter voltage of a bipolar transistor at the reference temperature, and σ is a saturation current temperature index determined by process. Finally, when the natural logarithms are expanded using the second-order Taylor expansion, the expansion can be performed as shown in the following equation.

$$Vout = a + bT + cT^2 \quad (12)$$

In this case, a, b, and c are respective predetermined constants.

The temperature characteristic 101 obtained has the peak voltage as shown in FIG. 3. For the non-linear component, various correction methods are described in the prior art documents. The correction methods are various but include many components that increase, for example, causes of variation, such as addition of another circuit.

In the embodiments according to the present invention, as described below, a current Iptat is changed with respect to temperature by utilizing bipolar transistor characteristics, to provide the above-described peak voltage a plurality of times for improvement of temperature characteristics.

First Embodiment

Figure 4:
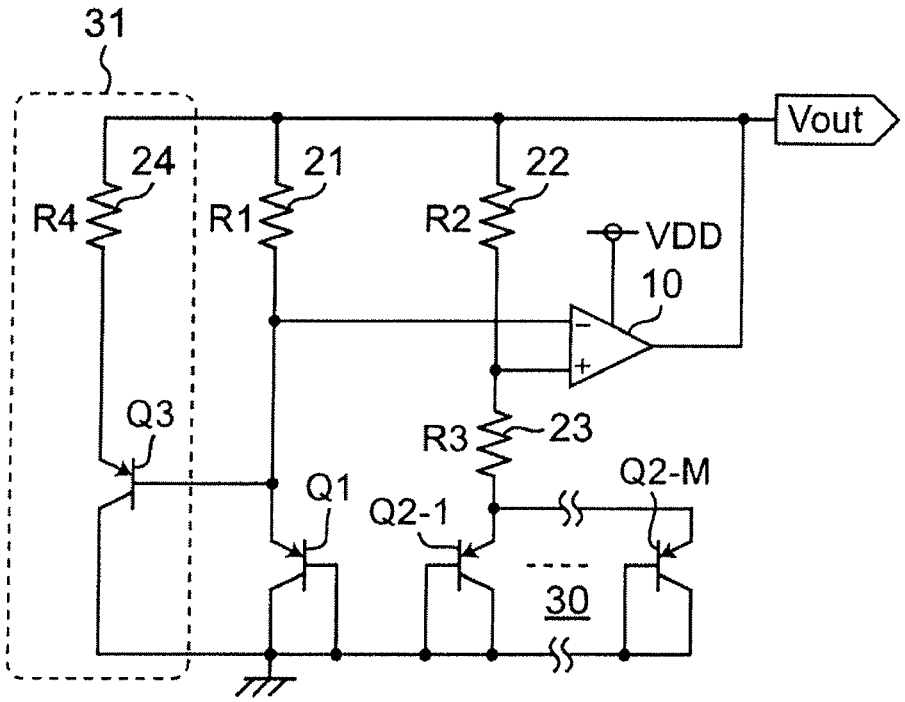
FIG. 4 is a circuit diagram showing an example configuration of a band gap reference voltage generator circuit according to a first embodiment of the present invention.

FIG. 4 is a circuit diagram showing an example configuration of a band gap reference voltage generator circuit according to a first embodiment of the present invention. Referring to FIG. 4, the band gap reference voltage generator circuit according to the first embodiment is characterized by further including a correction circuit 31 having a resistor R4 and a transistor Q3, as compared to the band gap reference voltage generator circuit of FIG. 2 according to the comparative example 2. In this case, transistors Q1, Q2-1 to Q2-M, and Q3 are, for example, PNP bipolar transistors. The above-mentioned difference will be described in detail below.

Referring to FIG. 4, the correction circuit 31 is connected in parallel with a series circuit of a resistor 21 and the transistor Q1. That is, the resistor 24 and the transistor Q3 are connected in series to form a t third series circuit. In this case, the output terminal of the operational amplifier 10 is grounded via the resistor 24 and an emitter and collector of the transistor Q3. In addition, a base of the transistor Q3 is connected to an emitter of the transistor Q1.

Meanwhile, in the typical band gap reference voltage generator circuit of FIG. 2 described above, the peak voltage is typically made to occur at the center of the assumed temperature range. As the temperature difference from the temperature Tpk at which the peak voltage occurs increases, the voltage difference increases. The present embodiment is characterized in that the circuit configuration, in which the correction circuit 31 is added to the band gap reference voltage generator circuit of FIG. 2 according to the comparative example 2, provides a plurality of peak voltages instead of one peak voltage to suppress voltage fluctuation.

Figure 5:
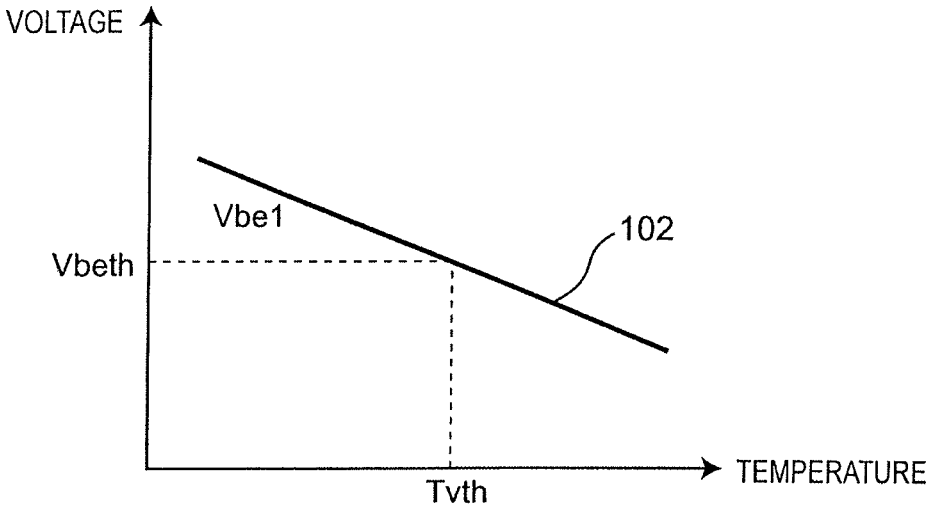
FIG. 5 is a graph illustrating operation of a correction circuit 31 of FIG. 4 and showing a temperature characteristic of a base-emitter voltage Vbe1 of a transistor Q1.

The operation of the correction circuit 31 depends on a base-emitter voltage Vbe1 of the transistor Q1. The base-emitter voltage Vbe1 has a temperature characteristic 102 having a negative slope is as follows as shown in FIG. 5 with respect to temperature. The transistor Q3 of the correction circuit 31 turns on when the base-emitter voltage Vbe1 exceeds a threshold voltage of the transistor Q3, and flows a base current Ib into the transistor Q1. Therefore, the correction circuit 31 forms a voltage generator circuit that generates a voltage corresponding to the base current Ib. Assuming that a threshold temperature at which the threshold voltage Vbeth occurs is Tvth, the band gap reference voltage generator circuit selectively operates under the following two conditions 1 and 2.

Temperature Temp<Tvth (Condition 1)

Temperature Temp≥Tvth (Condition 2)

(Condition 1) Temp<Tvth

Figure 6:
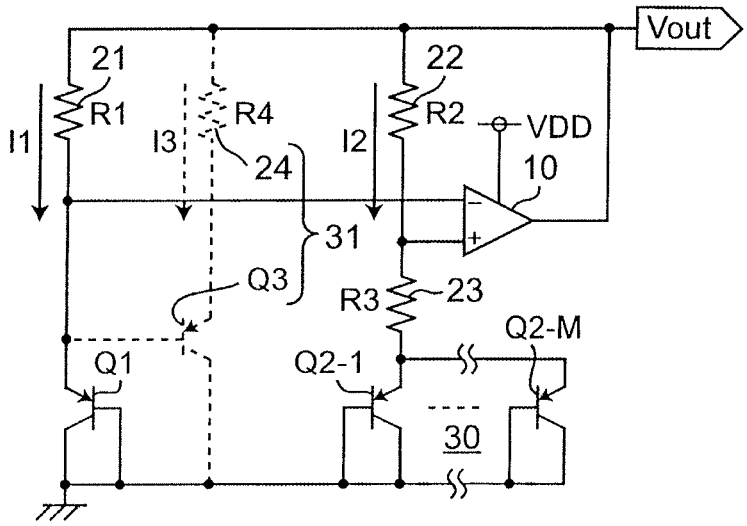
FIG. 6 is a circuit diagram showing an operation circuit when temperature Temp<threshold temperature Tvth in the band gap reference voltage generator circuit of FIG. 4.

FIG. 6 is a circuit diagram showing an operation circuit when temperature Temp<threshold temperature Tvth in the band gap reference voltage generator circuit of FIG. 4. As apparent from FIG. 6, since the transistor Q3 is off, the correction circuit 31 does not operate and the band gap reference voltage generator circuit performs the same operation as the conventional band gap reference voltage generator circuit of FIG. 2.

(Condition 2) Temp≥Tvth

Figure 7:
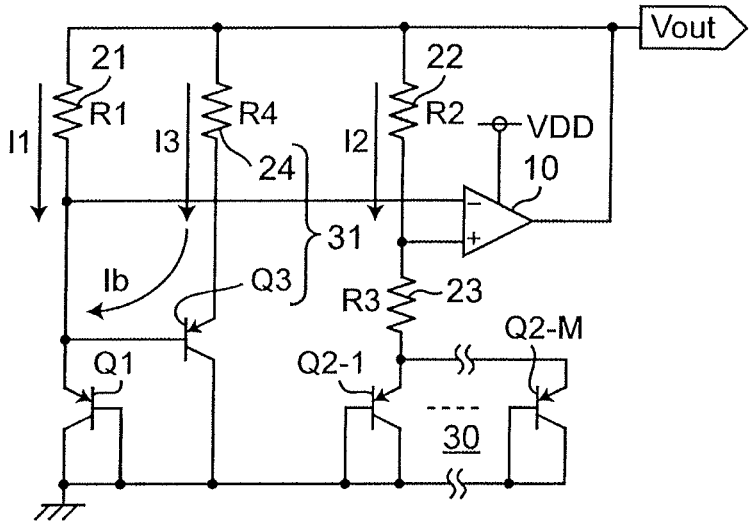
FIG. 7 is a circuit diagram showing an operation circuit when temperature Temp≥threshold temperature Tvth in the band gap reference voltage generator circuit of FIG. 4.
Figure 8:
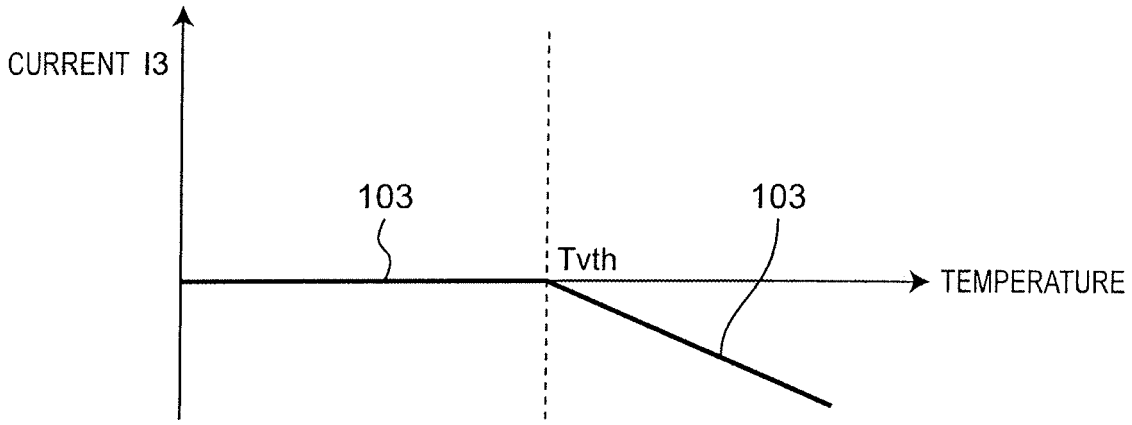
FIG. 8 is a graph showing a temperature characteristic of a current I3 in operation of FIG. 8.

FIG. 7 is a circuit diagram showing an operation circuit when temperature Temp≥threshold temperature Tvth in the band gap reference voltage generator circuit of FIG. 4. As apparent from FIG. 7, since the transistor Q3 is on, the correction circuit 31 operates. In this case, since the base-emitter voltage Vbe1 of the transistor Q1 has a negative slope with respect to temperature, a current I3 exhibits a characteristic 103 of FIG. 8 with respect to temperature Temp when the temperature Tvth, at which the base-emitter voltage Vbe1 is the threshold voltage Vbeth of the transistor Q3, is reached.

As compared to the typical band gap reference voltage generator circuit of FIG. 2, a current I1 of the band gap reference voltage generator circuit according to the present embodiment, to which the base current Ib of the transistor Q3 is added, is expressed by the following equation.

$$I1=I1+Ib=I1+I3/h_{fe} \tag{13}$$

$$\begin{aligned}\Delta Vbe &= ((R1\times R3)/R2)\times(I1+Ib) \\ &= ((R1\times R3)/R2)\times(I1+I3/h_{fe})\end{aligned} \tag{14}$$

In this case, $h_{fe}$ is a current amplification factor of the transistor Q3, and ΔVbe is a fluctuation component of the base-emitter voltage. In consideration of an actual non-linear component in the temperature characteristic, an output voltage Vout according to the present embodiment can be expanded as shown in the following equation.

$$Vout=a'+b\propto T+c'T^2 \tag{15}$$

Figure 9:
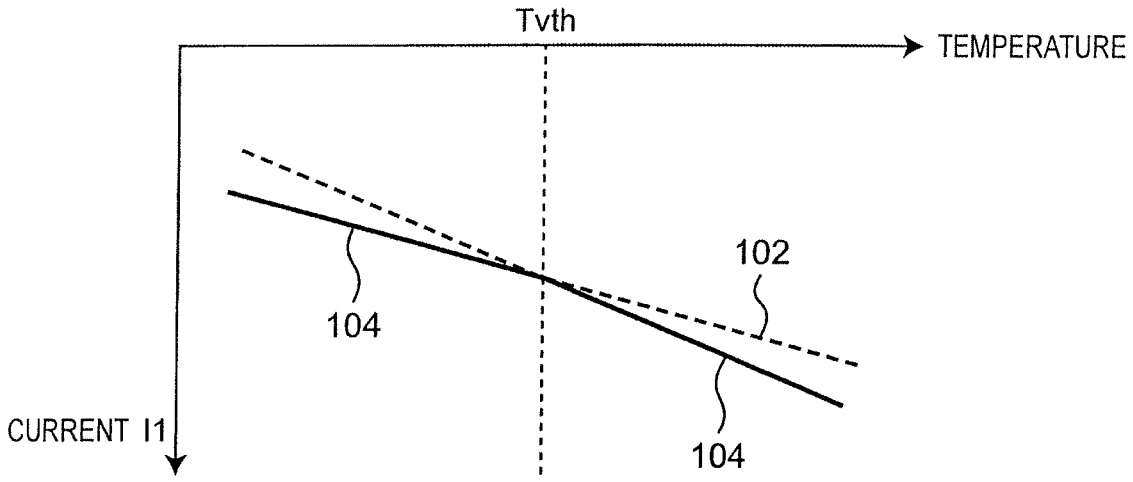
FIG. 9 is a graph showing a temperature characteristic of a current I1 in the operation of FIG. 8.

In this case, a', b', and c' are respective predetermined constants. The expansion can be performed to obtain the equation having different multipliers, as compared to the equation of the output voltage Vout of the typical band gap reference voltage generator circuit of FIG. 2 described above, allowing the output voltage Vout to have a characteristic having another peak voltage after a certain temperature is reached. Therefore, the current I1 in operation of FIG. 8 has a temperature characteristic 104 of FIG. 9. In this case, the temperature characteristic including the actual non-linear term may be set by the following setting procedures depending on the temperature Temp.

Figure 10:
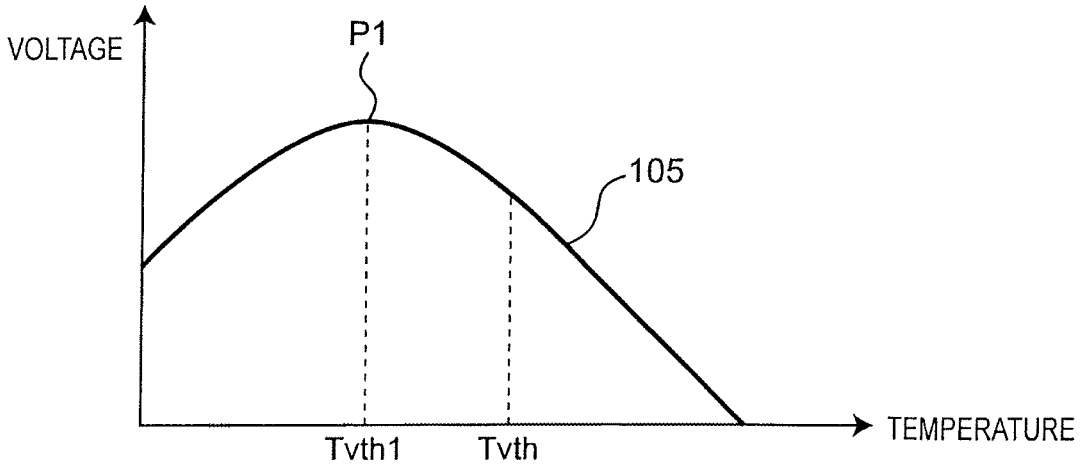
FIG. 10 is a graph showing a first setting procedure for obtaining a temperature characteristic of an output voltage according to the first embodiment.
Figure 11:
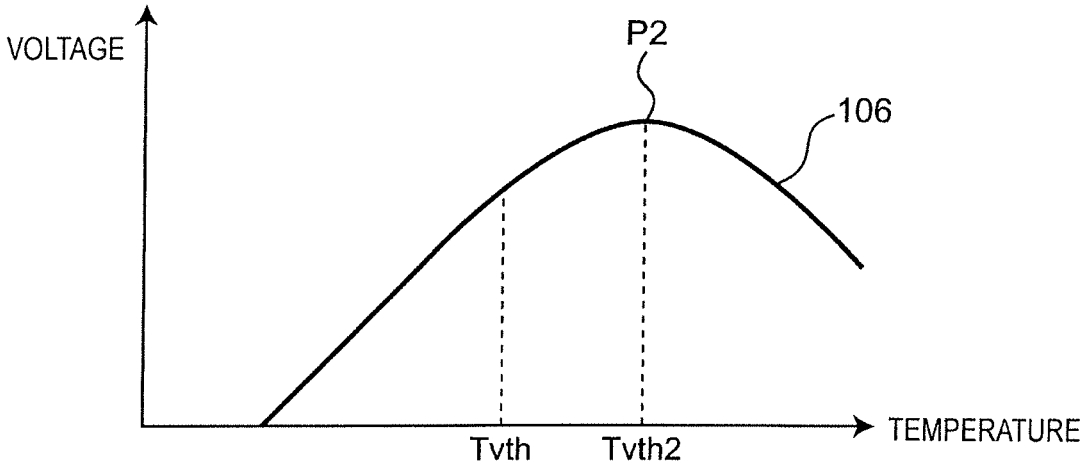
FIG. 11 is a graph showing a second setting procedure for obtaining the temperature characteristic of the output voltage according to the first embodiment.
Figure 12:
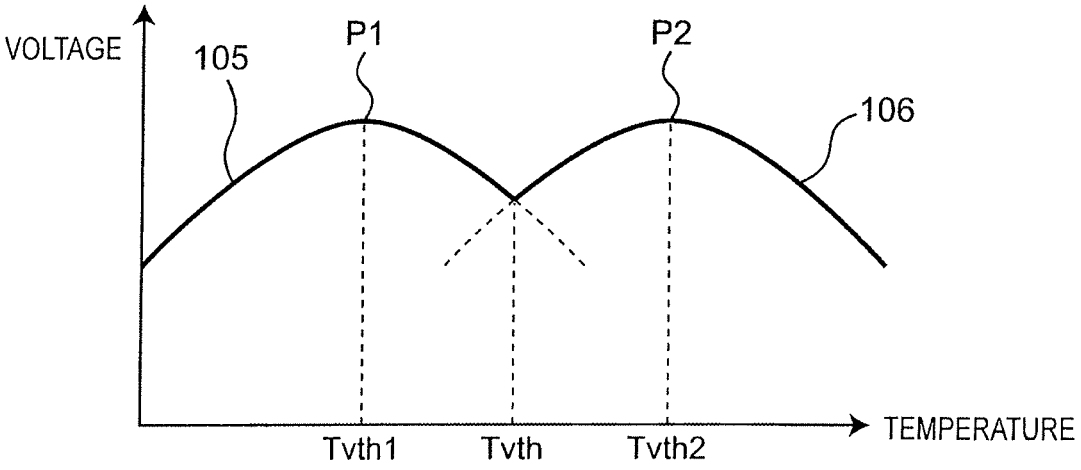
FIG. 12 is a graph showing a third setting procedure for obtaining the temperature characteristic of the output voltage according to the first embodiment.

FIGS. 10, 11 and 12 are graphs showing the setting procedures for obtaining the temperature characteristic of the output voltage according to the first embodiment.

First of all, as shown in FIG. 10, a temperature characteristic 105 is set by adjusting, for example, the resistance value R1 of the resistor 21 to generate a peak voltage P1 at a temperature Tvth1, which is equal to or lower than the threshold temperature Tvth.

Next, as shown in FIG. 11, in the case of the threshold temperature Tvth or higher, when the threshold temperature Tvth2 is set such that the base current Ib of the transistor Q3 increases, the temperature characteristic 106 is set by adjusting, for example, the resistance value R4 of the resistor 24 with a side peak voltage P2. This is because the correction circuit 31 increases a voltage Vptat corresponding to a current Iptat in the range equal to or higher than the threshold temperature Tvth.

Further, as shown in FIG. 12, the temperature characteristic having the peak voltages P1 and P2 at the respective currents can be achieved by combining the characteristics 105 and 106. This significantly improves temperature deviation as compared to the typical band gap reference voltage generator circuit of FIG. 2.

As described above, according to the reference voltage generator circuit of the present embodiment, when the emitter and base of the diode-connected PNP bipolar transistor Q1 are connected, the operation is performed in accordance with changes, due to temperature, of the base-emitter voltage Vbe. When the operation is performed, the base current Ib flows into the connected emitter, which allows the generation of the base-emitter voltage Vbe having two slopes with respect to temperature and the generation of the voltage Vptat. This provides two upwardly convex voltage curves having peak voltages at the respective two temperatures Tvth1 and Tvth2. By combining these voltage curves, the temperature characteristic 106 (FIG. 12) is achieved. Therefore, the band gap reference voltage generator circuit configured to have the temperature characteristic 106 reduces temperature deviation of the output voltage due to temperature and is capable of providing a highly accurate reference voltage without the need to increase the circuit size, as compared to the prior art.

Second Embodiment

Figure 13:
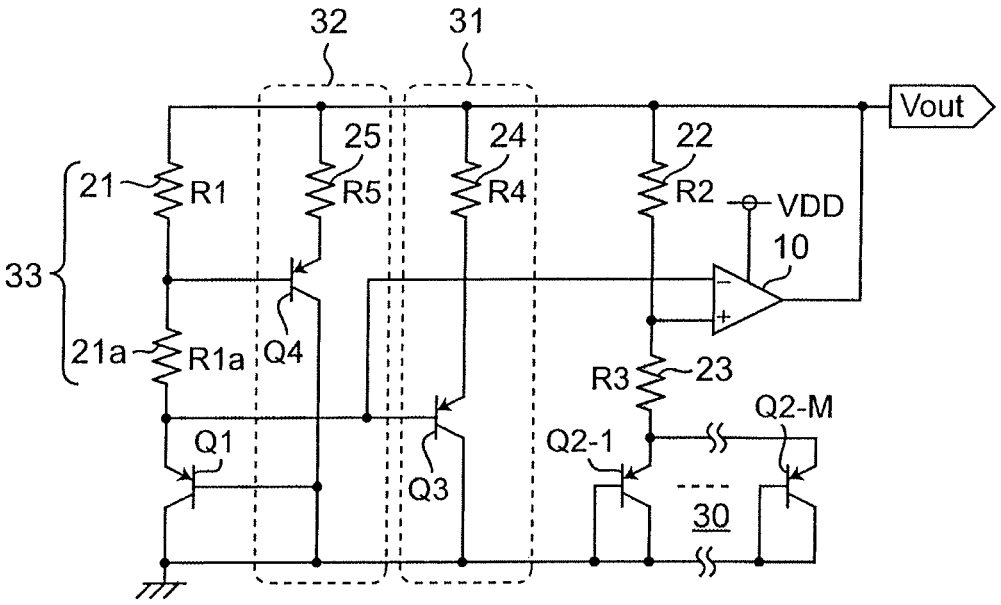
FIG. 13 is a circuit diagram showing an example configuration of a band gap reference voltage generator circuit according to a second embodiment of the present invention.

FIG. 13 is a circuit diagram showing an example configuration of a band gap reference voltage generator circuit according to a second embodiment of the present invention. Referring to FIG. 13, the band gap reference voltage generator circuit according to the second embodiment is different from the band gap reference voltage generator circuit of FIG. 4 according to the first embodiment in the following points.

(1) A correction circuit 32 is further included, which is a third series circuit in which a resistor 25 having a resistance value R5 and a PNP bipolar transistor Q4 are connected in series.

(2) Instead of the resistor 21 of FIG. 4, a series circuit 33 is included, in which a resistor 21 having a resistance value R1 and a resistor 21*a* having a resistance value R1*a* are connected in series.

The above-mentioned differences will be described in detail below.

Referring to FIG. 13, an output terminal of an operational amplifier 10 is grounded via the resistors 21 and 21*a* and an emitter and collector of a transistor Q1. In addition, the output terminal of the operational amplifier 10 is grounded via the resistor 25 and an emitter and collector of the transistor Q4. In this case, the transistor Q4 is, for example, a PNP bipolar transistor. The connection point of the resistor 21 and the resistor 21*a* is connected to a base of the transistor Q4, and the connection point of the resistor 21*a* and the emitter of the transistor Q1 is connected to a base of a transistor Q3. In this case, the correction circuit 32 configures a voltage generator circuit that generates a voltage corresponding to a base current of the PNP bipolar transistor Q4 and applies the voltage to the connection point of the resistors 21 and 21*a*.

Figure 14:
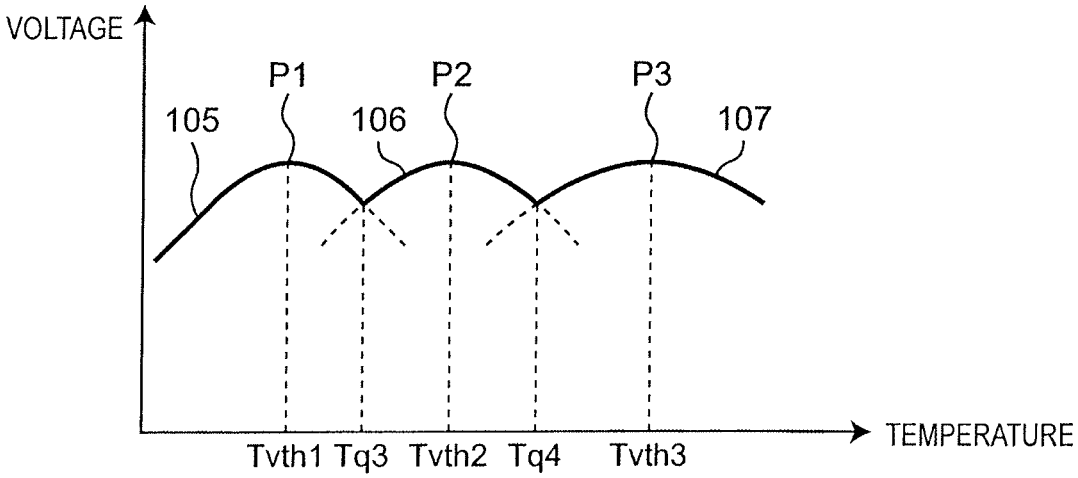
FIG. 14 is a graph showing a temperature characteristic of an output voltage of the band gap reference voltage generator circuit of FIG. 13.

FIG. 14 is a graph showing a temperature characteristic of an output voltage of the band gap reference voltage generator circuit of FIG. 13. As shown in FIG. 13, the addition of the resistor 21*a* to the ground side from the base of the transistor Q4 raises the voltage by a voltage (I×R1*a*) for the base of the transistor Q3, increasing the temperature at which the transistor Q4 starts to operate, as compared to the first embodiment of FIG. 4. As a result, temperature correction is performed in three stages, and it is possible to achieve a temperature characteristic obtained by combining temperature characteristics 105, 106, and 107 having three peak voltages P1, P2, and P3 of FIG. 14, respectively, such that the temperature characteristics 105, 106, and 107 are connected at temperatures Tq3 and Tq4. This avoids a voltage drop at high temperature, as compared to the first embodiment.

Modified Embodiments

In the foregoing embodiments, the temperature characteristics having the two peak voltages P1 and P2 and having the three peak voltages P1, P2 and P3 are achieved. The present invention is not limited to this, and a temperature characteristic having four or more peak voltages is achievable in a manner similar to that of the second embodiment.

In the foregoing embodiments, the temperature characteristics having a plurality of peak voltages are achieved by adding the correction circuits 31 and 32 to increase the base current Ib flowing into the base of the transistor Q1. The present invention is not limited to this, and a temperature characteristic having a plurality of peak voltages may be achieved by adding a correction circuit that draws the base current Ib of the transistor Q1.

In the foregoing embodiments, the diode-connected transistors Q1 and Q2 configure the respective PN junction devices. The present invention is not limited to this, and the diode-connected transistors Q1 and Q2 may be replaced by PN junction devices.

INDUSTRIAL APPLICABILITY

According to the reference voltage generator circuit of the present invention, it is possible to reduce temperature deviation of the output voltage due to temperature and provide a highly accurate reference voltage without the need to increase the circuit size, as compared to the prior art.

The invention claimed is:

1. A reference voltage generator circuit comprising:

a first voltage generator circuit that generates a first direct-current voltage, the first voltage generator circuit including a series connecting circuit of a first resistor and a first PN junction device;

a second voltage generator circuit that generates a second direct-current voltage, the second voltage generator circuit including a series connecting circuit of a second resistor, a third resistor, and a plurality of second PN junction devices being connected in parallel with each other; and an operational amplifier that generates a voltage difference between the first direct-current voltage and the second direct-current voltage, wherein the first and second PN junction devices are configured to include diode-connected first and second PNP bipolar transistors, respectively, wherein the reference voltage generator circuit generates a reference voltage based on a band gap by controlling respective currents flowing in the first and second voltage generator circuits based on the voltage difference, wherein the reference voltage generator circuit further comprises a third voltage generator circuit including a series connecting circuit of a fourth resistor and a third PNP bipolar transistor, the third voltage generator circuit being connected in parallel with the first voltage generator circuit, and wherein the third voltage generator circuit generates a third direct-current voltage corresponding to a base current flowing in the third PNP bipolar transistor, and applies the third direct-current voltage to the operational amplifier together with the first direct-current voltage.

2. The reference voltage generator circuit as claimed in claim 1, further comprising a fourth voltage generator circuit including a series connecting circuit of a fifth resistor and a fourth PNP bipolar transistor, the fourth voltage generator circuit being connected in parallel with the first voltage generator circuit, wherein the fourth voltage generator circuit generates a fourth direct-current voltage corresponding to a base current flowing in the fourth PNP bipolar transistor, and applies the fourth direct-current voltage to the operational amplifier together with the first direct-current voltage.

3. A reference voltage generation method for a reference voltage generator circuit comprising:

a first voltage generator circuit that generates a first direct-current voltage, the first voltage generator circuit including a series connecting circuit of a first resistor and a first PN junction device;

a second voltage generator circuit that generates a second direct-current voltage, the second voltage generator circuit including a series connecting circuit of a second resistor, a third resistor, and a plurality of second PN junction devices, the plurality of second PN junction devices being connected in parallel with each other; and an operational amplifier that generates a voltage difference between the first direct-current voltage and the second direct-current voltage, wherein the first and second PN junction devices are configured to include diode-connected first and second PNP bipolar transistors, respectively, wherein the reference voltage generator circuit generates a reference voltage based on a band gap by controlling respective currents flowing in the first and second voltage generator circuits based on the voltage difference, and wherein the reference voltage generator circuit further comprises a third voltage generator circuit including a series connecting circuit of a fourth resistor and a third PNP bipolar transistor, the third voltage generator circuit being connected in parallel with the first voltage generator circuit, and wherein the reference voltage generation method includes a step of, by the third voltage generator circuit, generating a third direct-current voltage corresponding to a base current flowing in the third PNP bipolar transistor, and applying the third direct-current voltage to the operational amplifier together with the first direct-current voltage.

4. The reference voltage generation method as claimed in claim 3, wherein the reference voltage generator circuit further comprises a fourth voltage generator circuit including a series connecting circuit of a fifth resistor and a fourth PNP bipolar transistor, the fourth voltage generator circuit being connected in parallel with the first voltage generator circuit, and wherein the reference voltage generation method includes a step of, by the fourth voltage generator circuit, generating a fourth direct-current voltage corresponding to a base current flowing in the fourth PNP bipolar transistor, and applying the fourth direct-current voltage to the operational amplifier together with the first direct-current voltage.

* * * * *